United States Patent [19]

Chaix

[11] Patent Number: 4,522,156

[45] Date of Patent: Jun. 11, 1985

[54] STEAM GENERATOR

[75] Inventor: Jean E. Chaix, Manosque, France

[73] Assignee: Commissariat a l'Energie Atomique, Paris, France

[21] Appl. No.: 386,075

[22] Filed: Jun. 7, 1982

[30] Foreign Application Priority Data

Jun. 16, 1981 [FR] France ..... 81 11833

[51] Int. Cl.[3] ..... F22B 1/06

[52] U.S. Cl. ..... 122/34; 122/492; 122/488

[58] Field of Search ..... 122/488, 492, 486, 32, 122/34

[56] References Cited

U.S. PATENT DOCUMENTS

| | | | |
|---|---|---|---|
| 3,227,142 | 1/1966 | Bell et al. | 122/34 |
| 3,437,077 | 4/1969 | Ammon et al. | 122/32 |
| 3,804,069 | 4/1974 | Bennett | 122/34 |
| 3,906,905 | 9/1975 | Andrieu et al. | 122/34 |
| 4,014,671 | 3/1977 | Andro et al. | 122/492 |
| 4,068,627 | 1/1978 | Giesecke et al. | 122/34 |
| 4,208,987 | 6/1980 | Chaix et al. | 122/34 |
| 4,261,298 | 4/1981 | McDonald et al. | 122/34 |

FOREIGN PATENT DOCUMENTS 2275731 1/1976 France .

*Primary Examiner*—Henry C. Yuen

*Attorney, Agent, or Firm*—Kerkam, Stowell, Kondracki, & Clarke

[57] ABSTRACT

Steam generator of the type comprising within a vertically axed type enclosure a plurality of U-tubes in which circulates a primary liquid and on the outer wall of which flows a secondary liquid, a cylindrical envelope surrounding the said tubes and defining with the inner wall of the enclosure an annular passage, whose lower part is connected to the inner space of the envelope, the latter being sealed in its upper part by a cover, which is itself surmounted by at least one device for separating the steam by centrifuging, a means for drying the steam in the upper part of the enclosure, said means incorporating at least one steam dryer surrounding the axis of the enclosure, each dryer being connected by its lower part to at least one discharge pipe for removing the water separated from the steam, wherein each discharge pipe is linked with a dynamic draining or bleeding device able to produce a pressure reduction or vacuum in order to suck in the water collected in the dryer. As a result, it is not necessary to maintain a clearance level or height in the discharge pipe.

The steam generator is more particularly intended for use in pressurized water nuclear reactors.

2 Claims, 2 Drawing Figures

STEAM GENERATOR

BACKGROUND OF THE INVENTION

The present invention relates to a steam generator, more particularly intended for use in pressurized water nuclear reactors and provided with a dynamic bleeding or draining device facilitating the removal of the water separated from the steam in the generator dryer.

FIG. 1 shows a steam generator of the type presently used in pressurized water reactors. The generator 1 comprises a cylindrical tight enclosure 2 surrounding a group of U-tubes 4 in which circulates the primary liquid. The lower part of the tubes 4 is fixed to a tube plate 6 and these tubes are connected on the one hand to an intake chamber 8 through which enters the hot primary fluid and on the other hand to a discharge chamber 10 permitting the cooled primary liquid to return to the reactor. A cylindrical envelope 12 surrounds the group of tubes 4 and defines with the inner wall of enclosure 2 an annular passage 14 for the circulation of the secondary liquid. The latter reaches the generator through a pipe 16 and then descends in annular passage 14 to tube plate 6, enters through a passage made in between plate 6 and the lower edge of envelope 12 and then rises along tubes 4, where it vaporizes on contact with the hot primary fluid. In the upper part of cylindrical envelope 12 there is a cover 18 in which are provided a plurality of passages such as 20, each being provided with a device for separating by centrifuging the water entrained with the steam. On leaving device 22 the steam still contains a certain amount of water, which must be eliminated before the steam reaches the turbine of the alternator. For this purpose the upper part of the generator is provided with a dryer 24, generally having passages provided with baffles on which the water drops are deposited and drop into the generator through discharge pipes 26. The generator shown in FIG. 1 has two superimposed dryers 24, 25 connected to the lower part of the generator by discharge pipes 26, 27 respectively. It is also possible to see a central collector 28, whose action completes that of discharge pipes 26, 27. FIG. 1 also shows that the free surface of the secondary liquid outside envelope 12 reaches the level of centrifuging device 22 and that the free ends of pipes 26, 27 and collector 28 are below this surface. In view of the fact that the dryers 24, 25 lead to a pressure drop in the steam circuit, a water level called the "clearance level" is established in the discharge pipes, so that the difference in level between the free surface of the liquid in the discharge pipes and within the enclosure 2 approximately corresponds to the pressure drop through dryers 24, 25. For satisfactory operation of the system, it is also indispensable that the water level in the discharge pipes be below the level of the lower part of dryers 24, 25. The need to maintain a minimum clearance level in the discharge pipes consequently leads to large overall dimensions level with the steam generators.

BRIEF SUMMARY OF THE INVENTION

The object of the present invention is to provide a steam generator obviating this disadvantage as a result of a device making it unnecessary to maintain a clearance level or height in the discharge pipes.

The present invention therefore specifically relates to a steam generator of the type comprising within a vertically axed type enclosure a plurality of U-tubes in which circulates a primary liquid and on the outer wall of which flows a secondary liquid, a cylindrical envelope surrounding the said tubes and defining with the inner wall of the enclosure an annular passage, whose lower part is connected to the inner space of the envelope, the latter being sealed in its upper part by a cover, which is itself surmounted by at least one device for separating the steam by centrifuging, a means for drying the steam in the upper part of the enclosure, said means incorporating at least one steam dryer surrounding the axis of the enclosure, each dryer being connected by its lower part to at least one discharge pipe for removing the water separated from the steam, wherein each discharge pipe is linked with a dynamic draining or bleeding device able to produce a pressure reduction or vacuum in order to suck in the water collected in the dryer.

According to another feature of the steam generator according to the invention, the device able to produce a pressure reduction or vacuum comprises a duct, whereof one end is connected to the secondary liquid supply circuit and whereof the other end, shaped like an injector similar to that of a water jet pump, is positioned within a pipe used for moving the water collected in the dryer.

According to another preferred embodiment of the invention, each discharge pipe issues into an annular pipe surrounding the axis of the enclosure, said annular pipe being linked with at least one removal pipe, itself provided with a bleeding or draining device able to produce a pressure reduction or vacuum.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
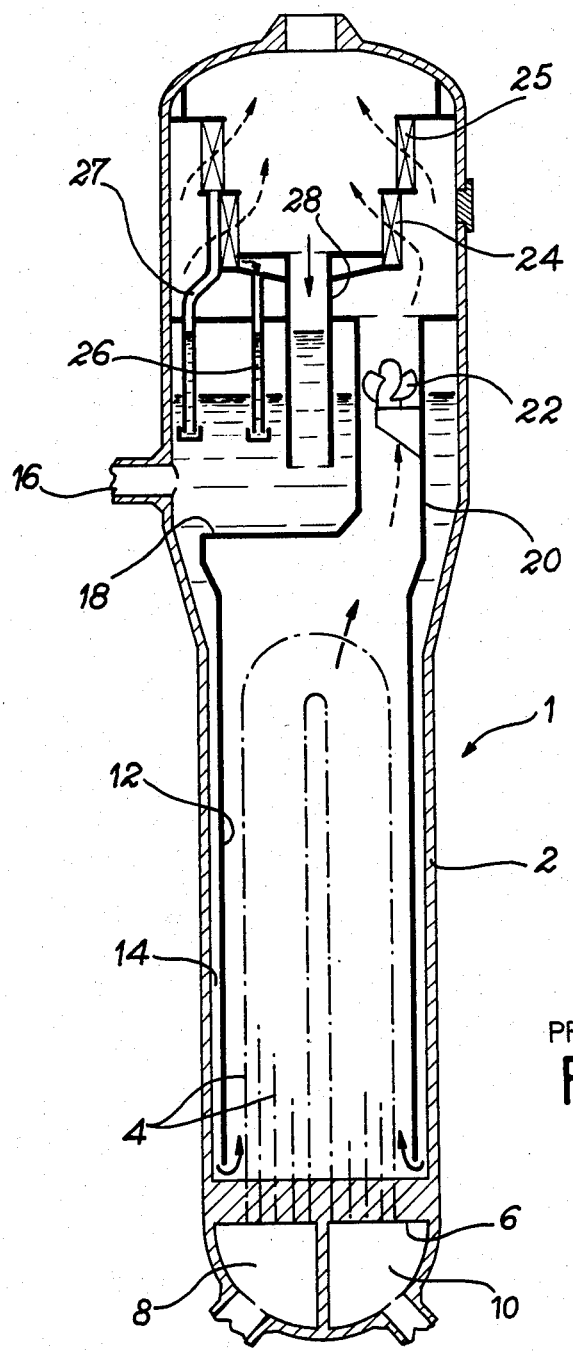
PRIOR ART FIG. 1
FIG. 1 already described, a vertical sectional diagrammatic view of a prior art steam generator.
Figure 2:
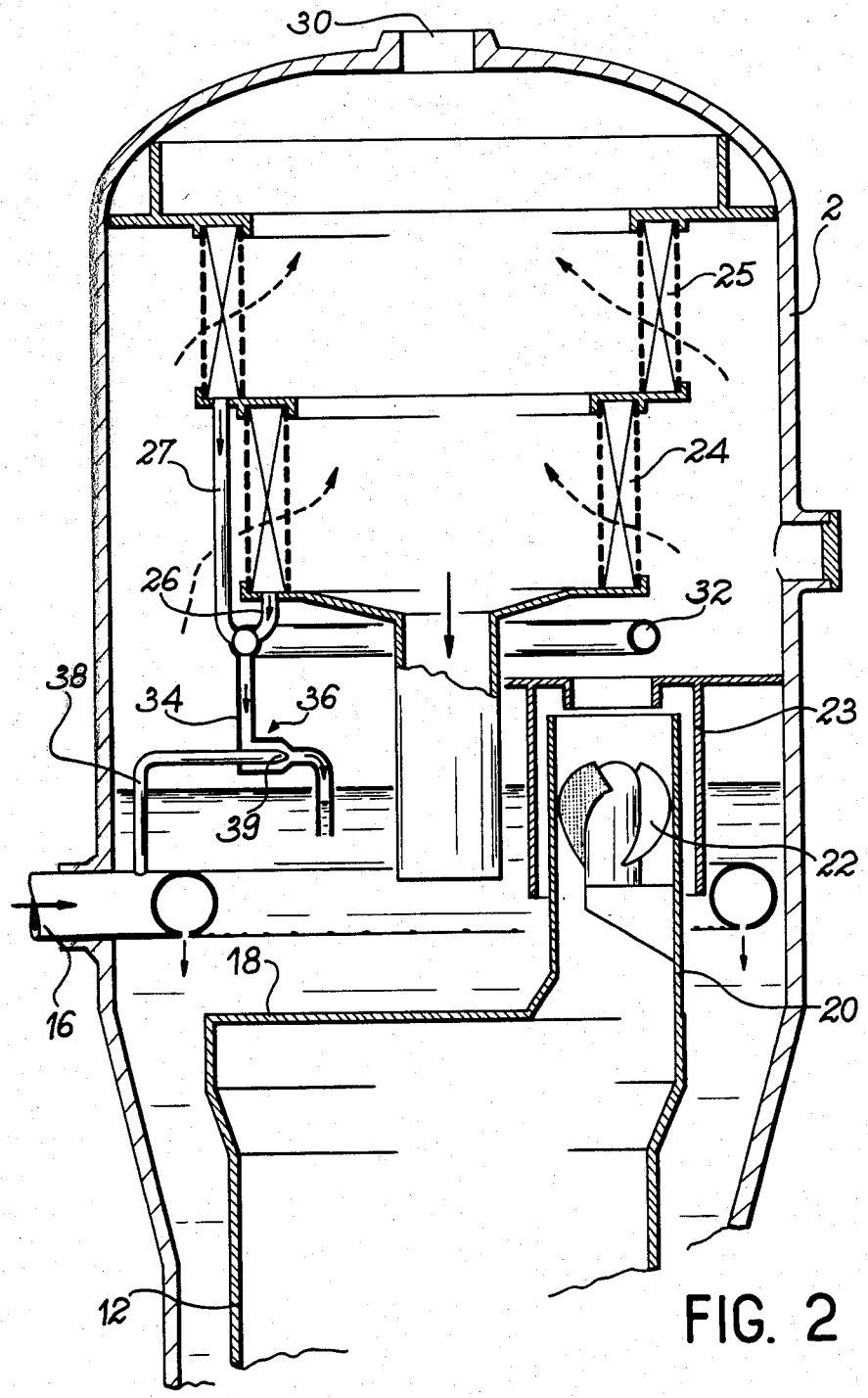
FIG. 2 a larger-scale vertical sectional view of the upper part of a steam generator according to the invention incorporating a dynamic bleeding or draining device.

FIG. 2 shows the upper part of a steam generator, which is similar to that of FIG. 1, and it is possible to see the secondary water intake 16 and cylindrical envelope 12, which is closed in its upper part by a cover 18. On the latter are provided a plurality of cylindrical passages such as 20 provided with a device 22 for the centrifugal separation of the water entrained by the steam. The water is discharged through a passage made between cylinder 20 and a sleeve 23 surrounding the latter, whilst the steam still containing a few water droplets enters the upper part of the enclosure and passes through the dryers. In the embodiment shown here, there are two superimposed dryers 24, 25 having a revolution shape about the axis of enclosure 2. Dryers 24, 25 have a plurality of vertical passages, provided with numerous baffles on which are deposited the water droplets entrained by the steam. The latted is then discharged through an opening 30 made in the upper part of the generator, whilst the water droplets fall into the lower part of dryers 24, 25 and pass into discharge pipes 26, 27. In the embodiment of FIG. 2, the discharge pipes such as 26 and 27 issue into an annular duct 32 surrounding the axis of the enclosure. Beneath annular duct 32 and linked therewith, there is a removal pipe 34 provided with a device 36 able to produce a pressure reduction or vacuum within pipe 34 and consequently the other pipes 26, 27 and 32. In the presently represented embodiment, device 36 firstly comprises a duct 38 connected to the secondary water supply circuit and issuing into pipe 34 by an injector or nozzle 39 similar to that of a water jet pump. At this point the portion of pipe 34 surrounding injector 39 has a convergent shape, in such a way that the water injected by nozzle 39 produces a pressure reduction which sucks up the water droplets contained in the discharge pipes 26, 27, as well as in the annular duct 32 and in the removal pipe 34. Thus, as a result of the suction applied to the discharge pipes 27, it is no longer necessary to maintain a clearance level or height in the discharge pipes 27 and it is possible to reduce the overall height of the generator.

Thus, the device according to the invention offers numerous advantages, the most important of which is that it is possible to reduce the height of the generator by eliminating the clearance level in the discharge pipe. The overall height may be reduced by approximately 1 meter, which leads to an appreciable material saving and consequently to a reduction in the cost of the installation. Furthermore, the fact of having a permanent suction action ensures that the water droplets separated from the steam in dryers 24 and 25 are more rapidly and efficiently discharged.

It is obvious that the invention is not limited to the single embodiment described hereinbefore, but numerous variants can be envisaged thereto without passing beyond the scope of the invention. Thus, it is possible to envisage the installation of several discharge pipes such as 26, each provided with a draining or bleeding device or, as in the represented embodiment, to connect several discharge pipes to a single draining or bleeding device.

What is claimed is:

1. A steam generator comprising: an enclosure having a vertical axis;

a plurality of U-tubes having inner and outer wall surfaces within said enclosure, primary liquid circulating within said U-tubes contacting the inner wall surfaces and secondary liquid contacting the U-tube outer wall surfaces;

a cylindrical envelope sealed at its upper part by a cover and surrounding said plurality of U-tubes, said cylindrical envelope and the inner wall of said enclosure together defining an annular passage, a secondary liquid supply line communicating with a portion of said enclosure above said cover, said portion in turn communicating with the upper part of said annular passage, and the lower part of said annular passage communicating with the interior of said envelope;

at least one passageway communicating through said cylindrical envelope cover to an upper part of said enclosure;

a centrifugal water/steam separator within said passageway;

at least one steam dryer of annular configuration surrounding the axis of said enclosure within said upper part of said enclosure for separating water from steam;

at least one discharge pipe connected to the lower part of said dryer for removing water separated from steam by said dryer; and a suction device connected to said discharge pipe for sucking in water separated by said dryer, said suction device including a removal pipe for discharging water separated by said dryer, a convergent section defined in said removal pipe, a duct connected at an inlet end to said secondary liquid supply line and having a nozzle at an outlet end injecting secondary liquid into said convergent section for producing suction.

2. A steam generator in accordance with claim 1, which further comprises an annular collector duct intermediate said discharge pipe and said removal pipe, an outlet end of said discharge pipe being connected directly to said annular collector duct for discharging water into said annular collector duct, and an outlet of said annular collector duct being in turn discharging into said removal pipe.

* * * * *